United States Patent [19]

Butts

[11] 4,147,340

[45] Apr. 3, 1979

[54] DOUBLE STREAM STACKER AND JOGGER

[76] Inventor: Homer F. Butts, 516 3rd Ave., NE., Grand Rapids, Minn. 55744

[21] Appl. No.: 857,422

[22] Filed: Dec. 5, 1977

Related U.S. Application Data

[63] Continuation of Ser. No. 738,289, Nov. 3, 1976, abandoned.

[51] Int. Cl.[2] ..... B65H 31/32; B65H 31/38

[52] U.S. Cl. ..... 271/218; 271/222

[58] Field of Search ..... 271/218, 221, 222

[56] References Cited

U.S. PATENT DOCUMENTS

| | | | |
|---|---|---|---|
| 623,371 | 4/1899 | Hopkins | 271/221 |
| 1,387,602 | 8/1921 | Veck | 271/222 |
| 1,699,284 | 1/1929 | English et al. | 271/218 |
| 1,863,465 | 6/1932 | Borrowdale | 271/221 X |
| 2,341,021 | 2/1944 | Curtis | 271/221 |
| 3,140,091 | 7/1964 | Reif et al. | 271/218 |
| 3,463,485 | 8/1969 | Atwood | 271/221 |
| 3,966,196 | 6/1976 | Simeth | 271/218 |

*Primary Examiner*—Robert W. Saifer

*Attorney, Agent, or Firm*—Berman, Aisenberg & Platt

[57] ABSTRACT

Apparatus for stacking and jogging cut sheets or carton blanks continuously includes a pair of side-by-side chambers comprising two side walls and a central divider panel and being open at the front, rear, top and bottom. A U-shaped elevator is disposed in each chamber and means is provided for raising and lowering each elevator individually. A plurality of vertically disposed, spaced stop fingers are mounted at the front of each chamber for outward swinging movement as a unit to permit removal of stacked blanks but normally operating as fixed stops for the blanks being fed to the chamber. Each chamber has a pair of vertical jogger plates and a motor, lever, linkage and pivot mechanism reciprocates one of the jogger plates toward and away from the divider panel and the other jogger plate toward and away from the stop fingers. A rod gate mechanism is disposed forwardly of the fingers and is swingable inwardly from a vertical to a horizontal position to hold the stream of blanks elevated while the already stacked blanks from the chamber are removed.

8 Claims, 12 Drawing Figures

FIG. 6.
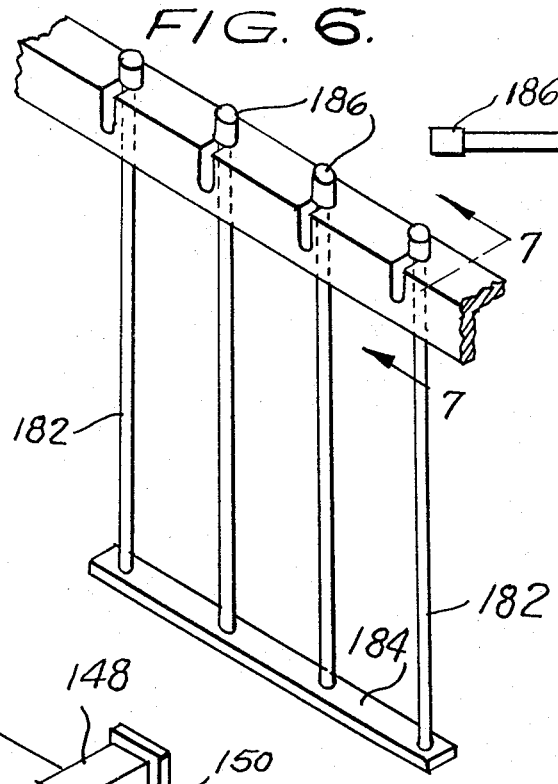
FIG. 7.
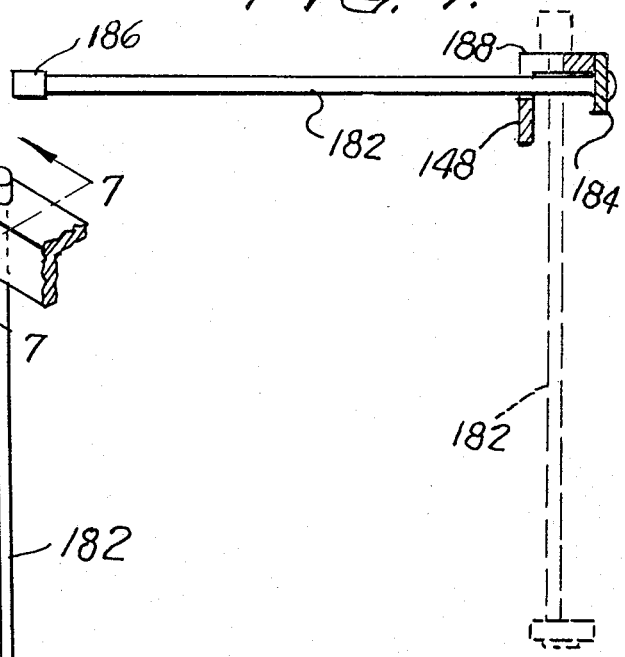
FIG. 8.
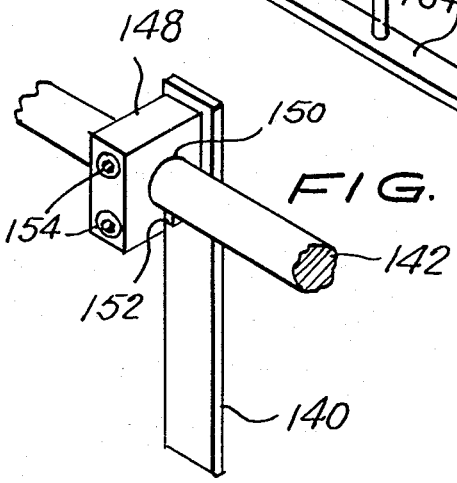
FIG. 9.
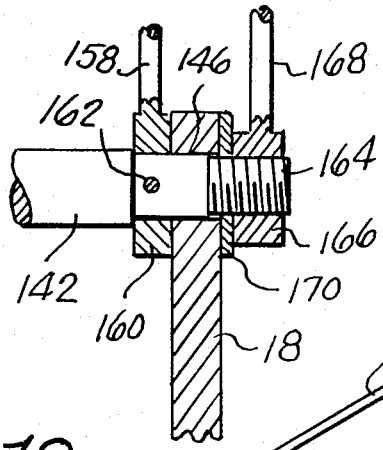
FIG. 10.
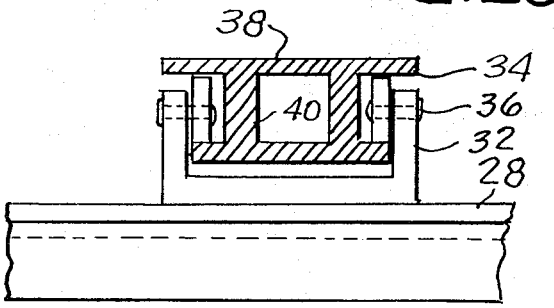
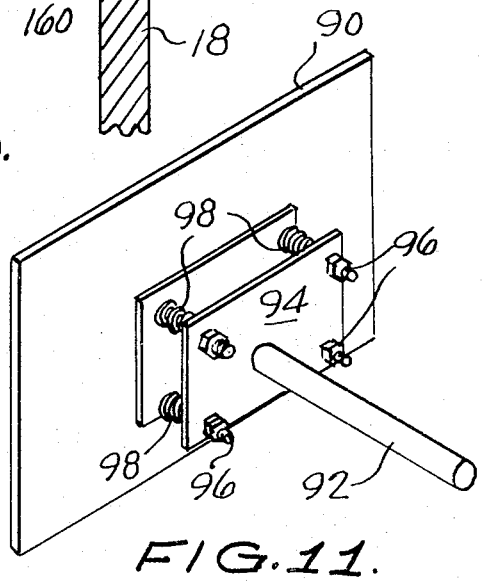
FIG. 11.

DOUBLE STREAM STACKER AND JOGGER

BACKGROUND OF THE INVENTION

1. Field of the Invention

Paper sheet collecting, stacking and jogging systems usually embody a transportation system such as one or more conveyor belts which advance single flat sheets or carton blanks individually along one or more paths at a high speed into single or multiple confinement areas where the sheets are stopped and begin to stack one on top of the other.

As the stack becomes too high to receive more sheets, the supporting base is automatically lowered. After the maximum height of the stack has been reached, the operation is halted completely until the finished stack is removed and a new stack can be started.

According to the present method, the feed of the sheets is not stopped when a stack is completed. Instead, a horizontal gate is inserted above the stack to support the new sheets being fed while the stack is removed from below the gate. The base support of the stack is then elevated to its initial position, the inserted gate is removed and the second stack is started by sheets accumulated on the gate dropping onto the stack support.

2. Description of the Prior Art

In the prior art both back-stopping of the leading edges of the advancing single sheets and jogging of the trailing edges so as to form a stack are well known However, the prior art devices generally require that the advancing conveyor be shut down completely for removal of the stack. This removal us usually accomplished by downward or lateral movement of the stack with respect to the back stopping and jogging elements.

SUMMARY OF THE INVENTION

According to the present invention, the advancing sheets are back-stopped along their leading edges and collected by vertically and laterally supporting their side edges on a descending support member, while jogging both the trailing and lateral edges against stop members. When the desired number of sheets have been collected in a stack, the descent of the support member is stopped, a gate is inserted horizontally above the stack to receive and hold further sheets from the continuous feed stream, the forward stop member is swung forwardly and upwardly and the stack of sheets is removed forwardly from its support member. The stack support member may then be elevated to its initial position, the stop member swung back, the inserted gate removed and the sheets on the gate dropped into the stacking area on to the elevated support member to start the formation of another stack. Thus the feeding and stacking are continuous even during periods of stack removal.

The invention permits a single operator to stack and jog two streams of sheets side by side simultaneously and to handle as many as 20,000 sheets per hour in each stream or 40,000 sheets per hour in both streams. It is unnecessary to stop either feed stream during the period when a completed stack is being removed. This capability is not inherent in the prior art. The apparatus utilized in the present invention is a very simple structure, easy to fabricate and assemble, easy to use, and economical to make.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of a specific embodiment when read in connection with the accompanying drawings wherein like reference characters indicate like parts throughout the several figures and in which:

FIG. 6 is a fragmentary perspective view showing one of the swinging rod gates;

FIG. 7 is a section taken along line 7—7 of FIG. 6 showing the gate lifted and inserted over the stack in its horizontal position in solid lines and in its normal vertical position during stacking of the sheets in broken lines;

FIG. 8 is a perspective view of one of the forward stop fingers;

FIG. 9 is a fragmentary sectional view taken on line 9—9 of FIG. 5;

FIG. 10 is a fragmentary sectional view showing a portion of a stack supporting elevator and its guide track;

FIG. 11 is a perspective view of a jogger plate and its piston rod assembly; and FIG. 12 is a fragmentary perspective view showing the chain drive portion of the support elevator and its connections.

DESCRIPTION OF THE PREFERRED EMBODIMENTS

Figure 1:
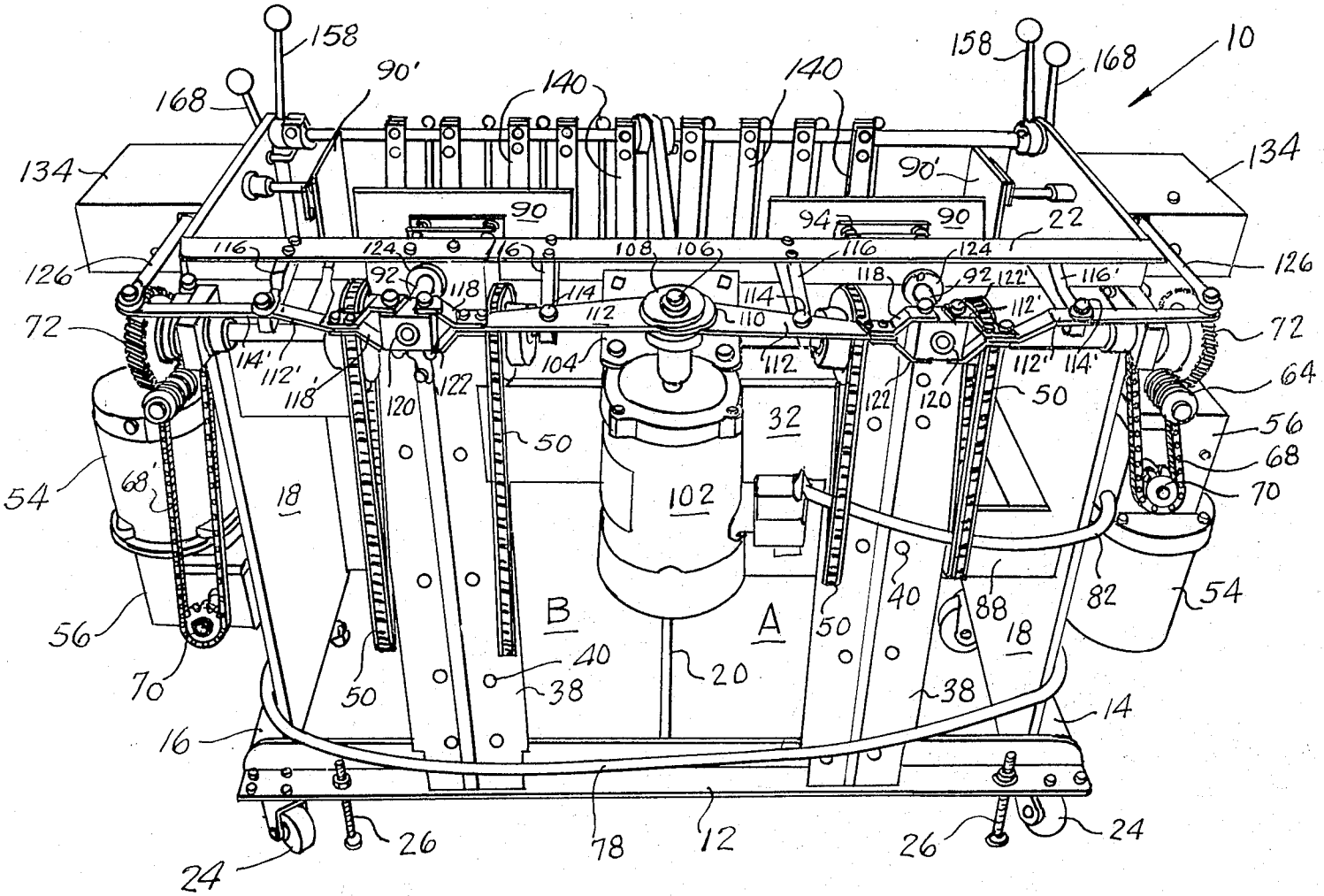
FIG. 1 is a perspective view taken from the rear and above of a machine for stacking and jogging a double stream of sheets according to the invention.

Referring now more particularly to the drawings, illustrated is a machine according to the invention which is intended to receive the output feed of a cutter on a printing press, or may be fed with a pair of streams of single sheets of paper or carton blanks proceeding along conventional conveyors, the two feed streams being directed over the top of the rear of the machine and toward the front stop fingers in a manner not shown, since feed and conveying means are well known in the art.

The machine is generally referenced 10 and comprises a rear angle-iron base member 12, two side angle-iron base members 14, 16 thus forming a three-sided base from, a pair of side walls 18 and a central partition wall 20. The walls are braced at their upper ends by an angle member 22 and define a pair of vertical chambers A and B, separated by the partition wall 20 and each of which is open at the front, bottom, rear and top. Caster wheels 24 are rollably secured to the bottom frame elements 12, 14 and 16 so that the machine may be readily moved to suitable positions adjacent to the paper feed conveyors. Vertical bolts 26 are threaded through openings in the base frame 12 and may be adjusted and fixed in positions by associated lock nuts to lift the machine off the caster wheels 24 and thus hold the machine in a fixed location.

Each chamber A, B is provided with an independently movable elevator in the form of a U and constructed of a horizontal angle-iron rear member 28 and two angle-iron side members 30, 30 fixed thereto. As best seen in FIG. 10, a U-shaped bracket 32 is welded to project centrally from the rear of the elevator elements 28 and a pair of wheels 34, 34 are rotatably journaled on pins 36, secured to and passing through the arms of the brackets 32. The wheels 34 roll upon and are guided by, as well as retained by, vertical track 41 which is formed in cross section in the shape of a double-T, the track 40 being secured to vertical standards 38 by means of screws 41 as best seen in FIG. 1. The standards 38, 38 are fixed at the centers and rear of chambers A, B being bolted or otherwise secured to the base member 12 and the upper brace 22.

Figures 2, 3:
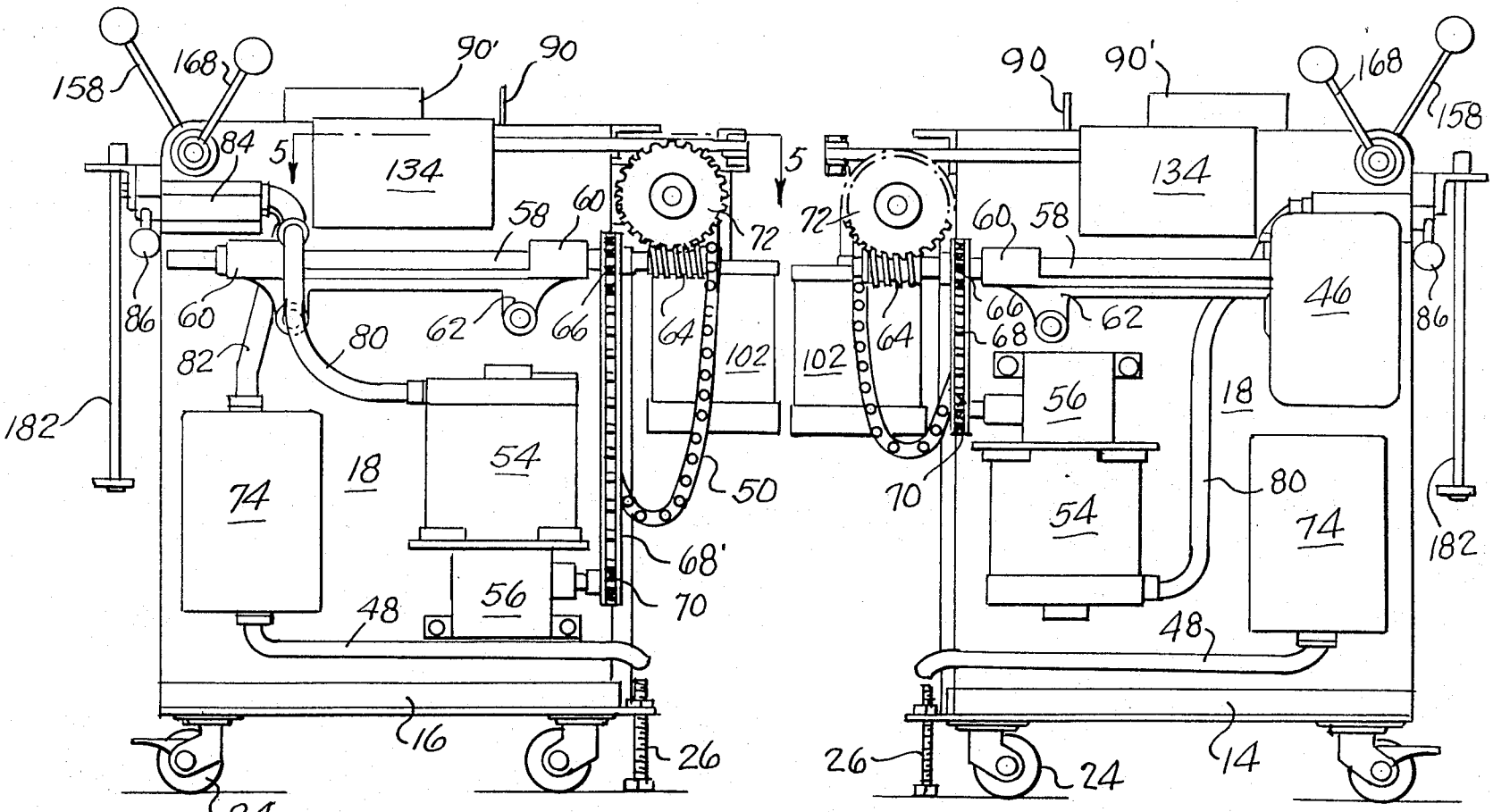
FIG. 2 is a right side elevation of the machine of FIG. 1.
FIG. 3 is a left side elevation of the machine of FIG. 1.
Figure 4:
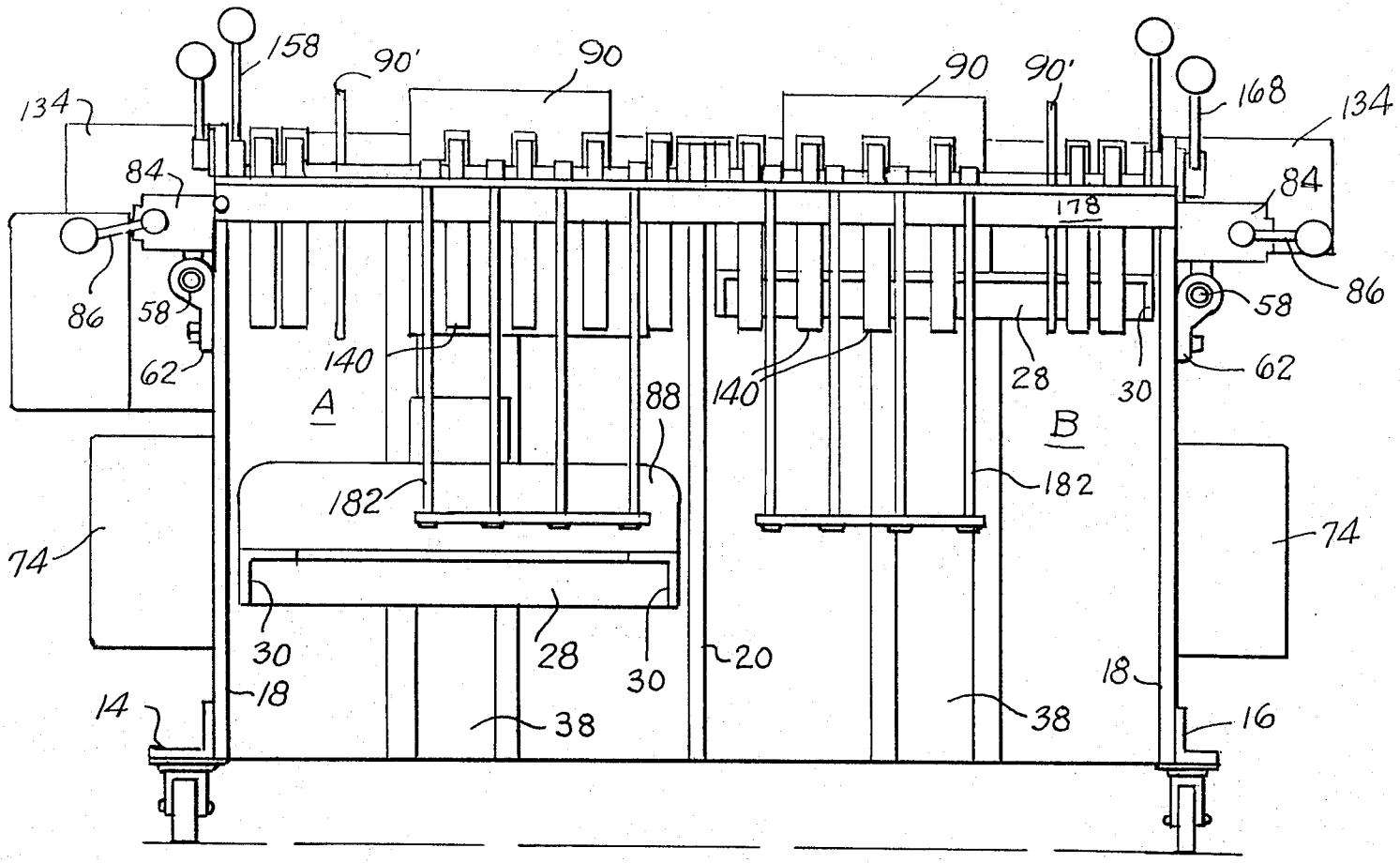
FIG. 4 is a front elevational view of the machine.

Each of the elevators 28, 30 in the two chambers is independently raised or lowered at variable rates of speed by a mechanism now to be described. A pair of drive shafts 42 are journalled for rotation in suitable bearings such as 44 and disposed horizontally near the top and rear of each of the chambers A and B. Fixed on each shaft 42 are a pair of sprockets 46 placed on each side of the vertical track holding standards 38. Trained over each sprocket 48 is a length of chain 50, one end of which is secured to the adjacent elevator member 28 or 30, see FIG. 12, and the other end of which is looped upwardly and secured to a fixed frame element such as the vertical standard 38 or a horizontal cross bracing member 52. Rotation of the shafts 42, through the described sprocket and chain construction will serve to raise or lower the elevators 28, 30 in each chamber independently in accordance with the direction of rotation of the shaft. To drive the shafts, a pair of motors 54, 54 are mounted on the outside surfaces of the side walls 18—18. The motors are reversible, have variable speeds, and are each provided with a gear reduction unit 56, 56. Referring particularly to FIGS. 2 and 3, it can be seen that there is a worm shaft 58, journaled for rotation in bushes 60, 60 held in clamp 62 mounted on each of the side walls 18 above the motors 54, 54. Each shaft 58 terminates in a worm 64 at the rear of the machine, and, they are rotated by sprocket wheels 66, 66 which are coupled to the output shafts of the gear reduction devices 56, 56 by chain belts 68, 68' trained over sprocket wheels 70, 70 on said output shafts. The worms 64, 64 mesh with worm gears 72, 72 fixed to the ends of shafts 42. Thus operation of the motors 54, 54 serve to rotate gears 72, 72 and the connected shafts 42, 42 thus elevating or lowering the elevators 28, 30 through the chains 50, 50. Power connection and circuit breaker boxes 74, 74 are mounted on the side walls of the machine as well as control box 76 which includes a potentiometer for varying the speeds of the two motors, the on-off switch and a reversal switch not shown, the circuitry for control of such motors being well known. The various parts of the circuit are connected by cables disposed in insulated conduits and referenced 78, 80 and 82. A motor reversal switch box is shown at 84, 84 the switches being operated by levers 86, 86. The elevator 28, 30 shown in chamber B of FIG. 4 is illustrated at the upper limit of its travel which is just under the jogger plates to be described. The elevator in chamber A is shown at an intermediate position in its descent, the stack of sheets supported by the elevator not being shown. Each elevator is provided with a vertical backing plate 88 welded or otherwise secured to the elevator member 28. Limit switches may be provided for stopping the elevator drive motors at the upper and lower limits of travel.

A pair of jogger plates 90, 90' are arranged in each of chambers of A and B at right angles to each other. Each of these jogger plates is resiliently supported from a piston rod 92 as best shown in FIG. 11. The piston rod at its inner end is centrally affixed to a small rectangular plate 94. Four bolts 96, arranged in a rectangle, are each welded at one end to the center portion of the jogger plate 90. Four coil springs 98 surround these bolts and separate the jogger plate 90 from the supporting plate 94, the assembly being retained by nuts 100 threaded on the inner ends of the bolts. The jogger plates 90' are resiliently supported in the same manner, but may differ slightly in size.

A single motor, 102 is utilized to simultaneously drive all of the jogger plates 90,90'. The motor 102, with its shaft vertical is supported by an L-shaped bracket 104 hung from the upper frame member 22 at its center. An intermediate portion of the motor is fixedly secured to the plate 52 which connects the vertical track standards 38, 38 at the rear of the machine. The motor is supplied with power through a cable in conduit 82. Drive axle 106 of motor 102 extends vertically upwardly and is fitted with a pair of eccentric bushings 108, 110 which are affixed in openings at ends of the pair of oppositely disposed levers 112, 112. The levers are fulcrumed on a pair of pivot pins 114, 114 which are supported by brackets, 116, 116 affixed to the upper frame member 22. A pair of yokes 118, 118 are affixed to the outer ends of the levers 112 and their yoke arms are pivotly secured to a pair of piston blocks 120, 120 by pivot pins 122, 122. The piston blocks 120, 120 are adjustably secured to the outer ends of piston rods 92 in a conventional manner not shown. The piston rods 92, 92 pass through bushings 124, 124 in plates dependent from the upper frame 22. It will be apparent from the above description that as the motor shaft 106 rotates, the eccentrics 108, 110 will cause the levers 112 to oscillate about pivot pins 114, 114. This engenders a similar oscillating movement forwardly and rearwardly of the piston blocks 120 carrying the piston rods 92 forwardly and rearwardly and constrained to such movement by the bushes 124, 124. Accordingly, the jogger plates 90, 90 which are resiliently secured to the piston rods will reciprocate forwardly and rearwardly toward and away from the front stop fingers to be described.

For simultaneously driving the jogger plates 90', a second set of levers 112', 112' are pivotally secured at one end to the piston blocks 120, 120 by means of yokes 118', 118'. Levers 112', 112' are centrally pivoted on vertical pins 114', 114', suitably supported by the brackets 116', 116'. Levers 112', 112' are pivotally connected by pivot bolts 124, 124 to the rear ends of forwardly extending link rods 126, 126. The forward ends of the rods 126, 126 are pivotally connected to one arm of a bell crank 128, 128. The other arms of the bell cranks are pivotally connected to a pair of cross heads 130, 130, which are in turn affixed to the ends of the piston rods 92 attached to the jogger plates 90',90'. The bell crank portion of the mechanism is suitably supported on bracket members 132, 132 within housings 134, 134. Openings 136, 136 are provided in a wall of each housing for entry of the link rods 126, 126 restraining the movements of the link rods to forward and rearward reciprocations. Similarly, the piston rods are slidably mounted in the cylindrical bushings 138, 138 so that their motion, engendered by turnings of the bell cranks 128, 128, are reciprocating movements laterally of the chambers A, B and toward and away from the center partition wall 20. It is thus apparent that the single motor 102 when activated, causes simultaneous reciprocating movements of all of the jogger plates 90, 90, 90', 90', and that the first pair reciprocate toward and away from the front stop fingers to be described, while the second pair reciprocate toward and away from the center partition of the chambers which acts as a lateral stop for sheets being fed to the chambers.

Figure 5:
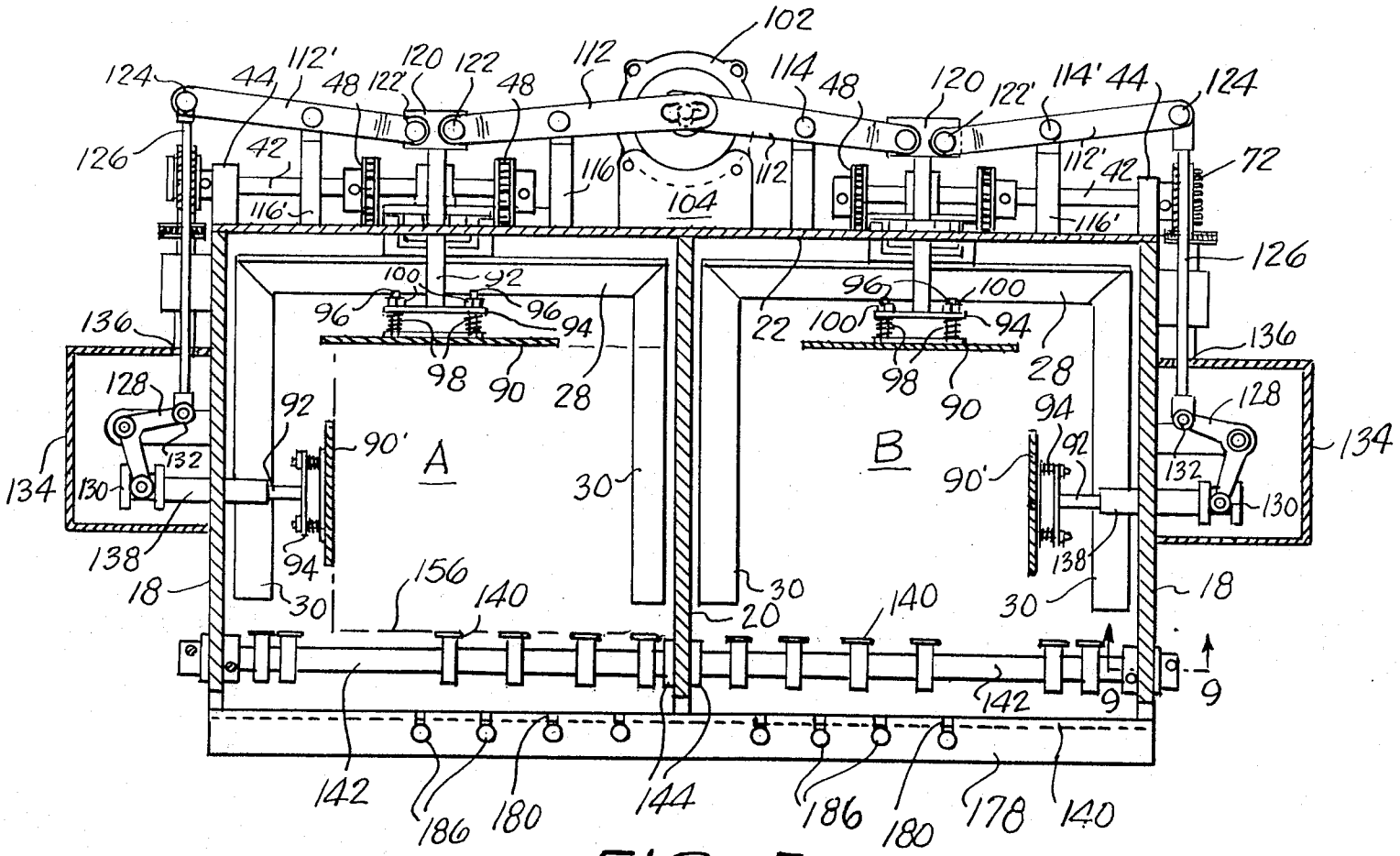
FIG. 5 is a sectional plan view of the machine taken along line 5—5, FIG. 2.

The forward stop means for sheets being fed to the chambers A, B comprise in each chamber a plurality of spaced fingers 140 which depend vertically and are adjustably affixed to a pair of rods 142, 142. The rods are horizontally disposed at the upper portions of each chamber in axial alignment, having their inner ends journaled in bushes 144, 144 and their outer ends journaled in openings 146 in the side walls 18, 18 as best seen in FIG. 9. The stop fingers 140 are supported by blocks 148 which have central openings 150, FIG. 8, to pass the rod 142 therethrough. A slot 152 communicates the bottom of the block 148 with the opening 150 so that the screws 154 which pass through the blocks and the fingers 140 when tightened firmly affix the finger at a selected spacing on the rod. FIG. 5 illustrates four fingers 140 in each of chambers A, B arranged to stop sheets being fed to the chambers and being stacked as shown in broken lines at 156 in chamber A. Additional fingers are provided on the rods 142 to change the spacing or to accommodate larger sheets. Each of the shafts 142 may be rotated to turn the fingers 140 forwardly and upwardly so as to permit removal of a completed stack. Such turning is accomplished by lever 158, FIG. 1 and FIG. 9, which is fixed to a reduced end portion of the shaft by means of collar 160 and pin 162. The outer end of each shaft is threaded at 164 to threadedly receive a locking collar 166 which is affixed to the operating rod 168. Rotation of lever 168 in one direction tightens the collar 166 on the threaded shaft portion 164 against the washer 170 and the side wall 18 of the machine to prevent rotation of the shaft and the attached stop fingers 140 as is required when sheets are being stacked and jogged. Rotation of the lever 168 in the opposite direction loosens the collar 166 and permits the shaft and attached stop fingers to be rotated forwardly and upwardly by manual movement of the operating lever 158.

As best seen in FIGS. 4, 5, 6 and 7, each chamber A and B is provided with a gate which can be shifted upwardly and inserted rearwardly above the stack being formed to support the feed stream of carton blanks while the stacked blanks within the chamber are removed forwardly of the machine. The gate structure comprises an upper angle-iron extending horizontally between the side walls 18, slightly below the level of the stop finger shafts 142, 142. The support angle-iron, referenced 178, has a plurality of spaced slots which extend in both the horizontal and vertical arms of the angle-iron and which are referenced 180. The gates themselves are comprised of a plurality of vertically disposed and spaced rods 182, which are affixed to a horizontal bottom member 184. The rods 182 respectively pass through the slots 180 in the support angle-iron 178 and are held thereby by heads 186 on each rod. Normally, the rod gates 182 are supported vertically to depend from the member 178 as shown in FIG. 6. When a stack has been completed and it is desired to remove the same, the gate 182, 184 is lifted vertically in slots 180 from the position shown in broken lines in FIG. 7 and then turned rearwardly to the solid line position wherein the gate lies across the top of the stack and supports the incoming stream of carton blanks being fed to the machine. The gate is held in its horizontal position shown in FIG. 7, by reason of the engagement of the rods and their bottom strap 184 with the horizontal flange portion of the support member 178.

Operation of the machine described above is as follows. The operator rolls the machine to a position behind a cutter on a printing press, or behind a pair of single sheet feed conveyors, and adjusts the bolts 26 to lock the machine in appropriate position to receive the feed streams over the rear of the machine and against the front finger stops 140. Both elevators 28 in chambers A and B are elevated to their upper positions as illustrated at the right of FIG. 4. With motor 102 operating the jogger plates 90, 90' oscillate in the manner explained and force the carbon blanks or sheets against the forward stop fingers 140 and the center partition wall 20 so that the sheets form precise stacks on the elevators with their marginal edges accurately aligned. As the stacks are being formed by the incoming sheets. When one of the elevators 28, 30 approaches its lowermost position at the bottom of chamber A or B, the operator de-energizes the appropriate motor 54, 56 and stops the elevator. At this time, the operator immediately lifts the chamber gate 182, 184 and swings it inwardly to a horizontal position above the completed stack as depicted in solid lines in FIG. 7. The gate rods 182 serve as a bottom supporting surface for stacking the incoming feed stream of carton blanks, and permits the operator to unlock the shaft 142 by moving lever 168 and to then immediately move lever 158 to turn the stop fingers 140 forwardly and upwardly. When this is done, the operator removes the complete stack from its elevator and chamber in a direction forwardly of the chamber. The appropriate motor is then energized to lift the elevator to its initial position; the gate 182, 184 is pulled outwardly and allowed to swing down to its normal position past the raised stop fingers whose spacing is adjusted to permit this. The levers 158 and 168 are then operated in turn to rotate the stop fingers 140 back to vertical position and lock them in this position. Blanks previously supported on gate 182, 184 are newlyincoming carbon blanks then fall on to the elevator and a new stack is started, the described procedure being repeated. Both stacks may be formed simultaneously in chambers A and B or one may be started slightly ahead of the other so as to permit the operator a little more time to remove a stack when completed. It is important to note that the described machine and its method of operation permits the infeed of carton blanks to be continuous without stopping during periods of removal of completed stacks, and that the machine is capable of handling a double stream and double stacking with but one operator, the controls being advantageously placed at the front and sides of the machine within easy reach of the operator.

Although a certain specific embodiment of the invention has been shown and described, it is obvious that many modifications thereof are possible. The invention, therefore, is not intended to be restricted to the exact showing of the drawings and description thereof, but is considered to include reasonable and obvious equivalents.

What is claimed is:

1. Apparatus for stacking and jogging cut sheets continuously in double stacks, comprising a base frame connected to two side walls and a central divider panel arranged to define a pair of side-by-side chambers open at the front, rear and top, a horizontal elevator disposed in each chamber and means to raise and lower each elevator, a plurality of vertically disposed spaced stop fingers at the front of each chamber mounted to act as a forward stop for sheets being fed to the chamber, a pair of vertically disposed jogger plates in each chamber and a means for reciprocating one of said plates toward and away from said divider panel and the other of said plates toward and away from said stop fingers, said means including a single motor device connected by eccentrics and linkage means to both pairs of jogger plates, said means for reciprocating said jogger plates further including a motor with a vertical shaft, a pair of horizontal, centrally pivoted levers connected by eccentrics to the motor shaft at one end and pivotally coupled at their other end to a pair of piston rods, each secured to one of the jogger plates and reciprocable forward and away from said stop fingers, a second pair of centrally pivoted levers pivotally coupled to said pair of piston rods at one end and pivotally connected to forwardly extending link rods at their other ends, the free ends of the link rods being each pivotally secured to one arm of a bell crank whose other arm is pivotally secured to one of a second pair of piston rods each secured to one of the jogger plates and reciprocable toward and away from said central divider.

2. Apparatus for stacking and jogging cut sheets according to claim 1, wherein each said jogger plate is connected to one of said piston rods by a flat member secured perpendicularly to the rod and resilient means compressibly spacing the jogger plate parallel to the flat member.

3. Apparatus for stacking and jogging cut sheets continuously in double stacks, comprising a base frame connected to two side walls and a central divider panel arranged to define a pair of side-by-side chambers open at the front, rear and top, a horizontal elevator disposed in each chamber and means to raise and lower each elevator, a plurality of vertically disposed spaced stop fingers at the front of each chamber mounted to act as a forward stop for sheets being fed to the chamber, a pair of vertically disposed jogger plates in each chamber and a means for reciprocating one of said plates toward and away from said divider panel and the other of said plates toward and away from said stop fingers, said means including a single motor device connected by eccentrics and linkage means to both pairs of jogger plates, said elevator being U-shaped and said means to raise and lower each elevator including a vertically disposed track at the center and rear of each chamber, wheel means secured to each U-shaped elevator and rollably guided and held in said tracks, a pair of coaxially aligned shafts at the rear and top of said chambers, means for driving said shafts, a pair of sprocket wheels spacedly fixed on each of said shafts, and a flexible member trained over each sprocket wheel with one end secured to the adjacent elevator and the other end secured to the frame.

4. Apparatus for stacking and jogging cut sheets according to claim 3, wherein said means for driving said shafts includes a pair of motors mounted on said side walls, a worm shaft connected by sprocket and belt means to each of said motors and a gear coupling with each one of said worm shafts and fixed to one of said elevator shafts.

5. Apparatus for stacking and jogging cut sheets continuously in double stacks, comprising a base frame connected to two side walls and a central divider panel arranged to define a pair of side-by-side chambers open at the front, rear and top, a horizontal elevator disposed in each chamber and means to raise and lower each elevator, a plurality of vertically disposed spaced stop fingers at the front of each chamber mounted to act as a forward stop for sheets being fed to the chamber, a pair of vertically disposed jogger plates in each chamber and a means for reciprocating one of said plates toward and away from said divider panel and the other of said plates toward and away from said stop fingers, said means including a single motor device connected by eccentrics and linkage means to both pairs of jogger plates, each of said stop fingers being adjustably affixed to a central rod for varying the spacing between the fingers, said central rod having a lever for turning the same to swing upwardly and outwardly, and locking means for securing the control rod against angular movement.

6. Apparatus for stacking and jogging cut sheets according to claim 5, wherein said locking means comprises a locking lever having a nut portion threaded on the end of the associated control rod and exerting clamping pressure against the base of the control rod lever and a side wall of the chamber.

7. Apparatus for stacking and jogging cut sheets according to claim 5, wherein there is additionally provided an inwardly insertible support gate at the front of each of said chambers, said gates, each including a horizontal bottom strap secured to a plurality of vertical rods spaced along the strap, said rods each extending through an elongated vertical and horizontal slot in the arms of an angle-iron support, the gate being supported in vertical disposition by heads on said rods but being swingable to a horizontal inserted position by lifting the rods as a unit and turning them in their slots to extend horizontally over a completed stack of sheets, whereby to hold the feed stream of paper sheets in elevated condition while unloading the completed stack in the chamber from under the gate.

8. Apparatus for stacking and jogging cut sheets according to claim 7, wherein the spacing of said gate rods is such as to permit the rods to pass between the stop fingers during swinging movements of either the stop fingers or the gates.

* * * * *